US008870021B2

(12) United States Patent
Smyers

(10) Patent No.: US 8,870,021 B2
(45) Date of Patent: Oct. 28, 2014

(54) AIR-TIGHT CERAMIC OR GLASS VESSELS AND LID SYSTEMS

(75) Inventor: Justin Smyers, Newport Beach, CA (US)

(73) Assignee: Snapware Corporation, Mira Loma, CA (US)

( * ) Notice: Subject to any disclaimer, the term of this patent is extended or adjusted under 35 U.S.C. 154(b) by 303 days.

(21) Appl. No.: 13/193,478

(22) Filed: Jul. 28, 2011

(65) Prior Publication Data

US 2012/0024856 A1 Feb. 2, 2012

Related U.S. Application Data

(60) Provisional application No. 61/369,479, filed on Jul. 30, 2010.

(51) Int. Cl.

| | |
|---|---|
| ***B65D 45/22*** | (2006.01) |
| ***B65D 41/18*** | (2006.01) |
| ***B65D 43/02*** | (2006.01) |
| ***A47G 19/26*** | (2006.01) |
| ***A47G 19/02*** | (2006.01) |
| ***B65D 45/20*** | (2006.01) |
| ***B65D 21/02*** | (2006.01) |

(52) U.S. Cl.

CPC ..... *A47G 19/26* (2013.01); *B65D 2543/00842* (2013.01); *B65D 2543/00537* (2013.01); *B65D 43/0202* (2013.01); *B65D 2543/00361* (2013.01); *B65D 2543/00092* (2013.01); *B65D 2543/00972* (2013.01); *A47G 19/02* (2013.01); *B65D 45/20* (2013.01); *B65D 2543/00027* (2013.01); *B65D 21/0219* (2013.01); *B65D 2543/00527* (2013.01); *B65D 2543/00296* (2013.01)

USPC ..... 220/784; 220/795; 220/326; 220/380; 220/781

(58) Field of Classification Search

USPC ..... 220/324, 326, 276, 378, 380, 784, 788, 220/795, 270, 781, 806, 287, 786, 799

See application file for complete search history.

(56) References Cited

U.S. PATENT DOCUMENTS 3,532,244 A * 10/1970 Yates, Jr. ..... 215/272
3,688,942 A * 9/1972 Mitchell et al. ..... 220/784

(Continued)

FOREIGN PATENT DOCUMENTS

CA 2314537 1/2002
DE 202010007217 9/2010

(Continued)

OTHER PUBLICATIONS

Written Opinion of the International Searching Authority, PCT/US2011/046025, mailed Dec. 18, 2011.

(Continued)

*Primary Examiner* — Fenn Mathew
*Assistant Examiner* — James N Smalley
(74) *Attorney, Agent, or Firm* — Larry K. Roberts

(57) ABSTRACT

An exemplary embodiment of a vessel-lid combination includes a ceramic or glass vessel having an open top surrounded by a peripheral edge, a lid fabricated of a plastic material, and a seal structure. The lid is configured to attach to the open top by means of a latch or set of latches integrated with the lid, and the seal structure is configured to provide an air-tight seal between the lid and the peripheral edge of the vessel when the lid is attached to the vessel.

5 Claims, 20 Drawing Sheets

(56) References Cited

U.S. PATENT DOCUMENTS

| | | | | |
|---|---|---|---|---|
| 3,817,419 | A * | 6/1974 | Moller et al. | 220/315 |
| RE28,720 | E * | 2/1976 | Sedlak | 206/501 |
| 5,641,065 | A | 6/1997 | Owens et al. | |
| 6,050,199 | A * | 4/2000 | Anderson et al. | 105/377.07 |
| 6,494,338 | B1 * | 12/2002 | Schultz | 220/328 |
| 6,874,650 | B2 * | 4/2005 | Welsh et al. | 220/519 |
| 2005/0139604 | A1 * | 6/2005 | Kim | 220/788 |
| 2009/0078715 | A1 | 3/2009 | Kim | |
| 2009/0218360 | A1 * | 9/2009 | Suk | 220/784 |

FOREIGN PATENT DOCUMENTS

| | | |
|---|---|---|
| EP | 1550617 | 6/2005 |
| FR | 2607114 | 5/1998 |
| KR | 20090009935 | 10/2009 |
| WO | 2007064833 | 6/2007 |

OTHER PUBLICATIONS

International Search Report, PCT/US2011/046025, mailed Dec. 18, 2011.

* cited by examiner

AIR-TIGHT CERAMIC OR GLASS VESSELS AND LID SYSTEMS

CROSS-REFERENCE TO RELATED APPLICATION

This application claims priority from provisional application No. 61/369,479, filed Jul. 30, 2010, the entire contents of which application is incorporated herein by this reference.

BACKGROUND

Ceramic and glass bowls and dishes have long been used as dinnerware. Dinnerware refers to the tableware (plates, platters, bowls and the like) used in serving a meal.

Almost all quality dinnerware is made from a ceramic material coated with a glaze. A ceramic is an inorganic, nonmetallic solid prepared by the action of heat and subsequent cooling. Ceramic dinnerware is usually divided into four common fired grades. Earthenware is the most porous, and least vitrified. Stoneware is more durable and vitrified than earthenware. Porcelain is tougher and more vitrified than stoneware. Bone China is the toughest and most vitrified (most like glass) and can therefore be made utilizing the thinnest gage.

A general definition of ceramic as used herein is any of various hard materials made by forming and firing a nonmetallic mineral, as clay. Crystalline ceramics encompass earthenware, stoneware, porcelain, and bone China. Noncrystalline ceramics encompass glass, which are melted and poured into molds.

Ceramic dinnerware can typically be made by molding or forming the material in a clay or paste form into the shape, and then firing or heating the material until it sets or hardens. Glass dinnerware is typically made by pouring molten glass into a mold, and allowing it to cool. The tolerances on these types of dinnerware are generally relatively large.

BRIEF DESCRIPTION OF THE DRAWINGS

Features and advantages of the disclosure will readily be appreciated by persons skilled in the art from the following detailed description when read in conjunction with the drawing wherein.

DETAILED DESCRIPTION

Figure 1:
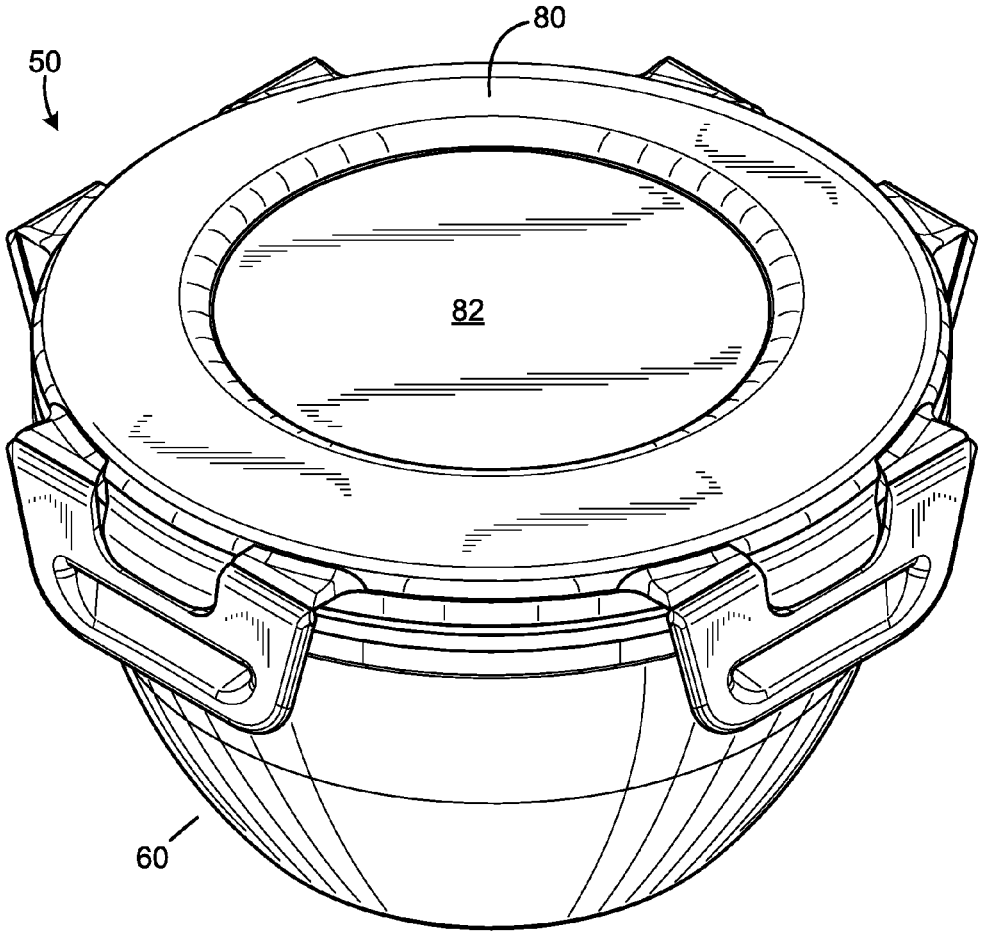
FIG. 1 is an isometric view of an exemplary embodiment of a bowl with a lid in an attached configuration.
Figure 1A:
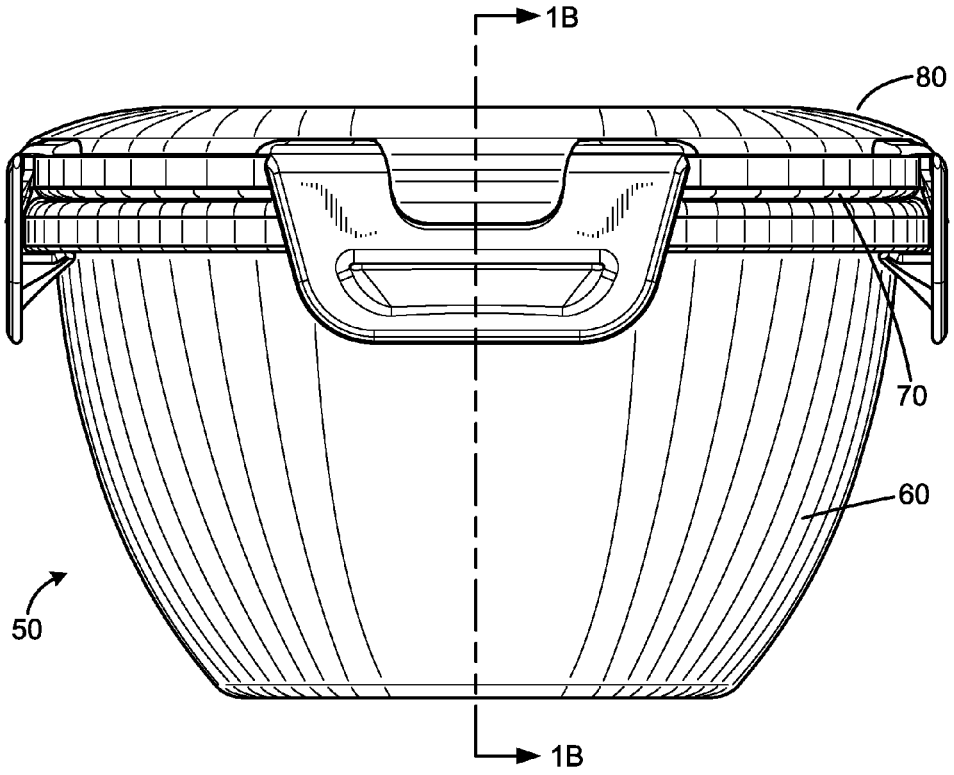
FIG. 1A is a front elevation view of the bowl and lid of FIG. 1.

In the following detailed description and in the several figures of the drawing, like elements are identified with like reference numerals.

An exemplary embodiment of a dinnerware vessel-lid combination includes a ceramic or glass vessel having an open top surrounded by a peripheral edge, a lid fabricated of a plastic material, and a seal structure. The lid is configured to attach to the open top by means of a latch or set of latches integrated with the lid, and the seal structure is configured to provide an air-tight seal between the lid and the peripheral edge of the vessel when the lid is attached to the vessel. In one exemplary embodiment, the vessel is a plate. In another embodiment, the vessel is a bowl. In other exemplary embodiments, the vessel may be rectangular or oval in shape.

FIGS. 1-5B illustrate features of an exemplary embodiment of an air-tight ceramic vessel and lid system 50. The system includes the vessel 60, in this example a bowl, a seal member 70, and a lid 80.

The vessel 60 in this exemplary embodiment is fabricated of a ceramic material, to provide a stoneware, earthenware, bone china, porcelain or other ceramic or glass vessel. The vessel in this embodiment is a unitary structure, defining a sidewall portion 60A and a bottom wall 60B. In this example, the bottom wall 60B defines a bottom recess 60C and a peripheral foot portion 60E. The top periphery of the sidewall portion 60A defines a lip portion 60D. The lip portion includes a locking lip 60D-1 which provides a locking surface for the latching lid. The locking lip includes a latch receiving curved surface 60D-2 and locking surface 60D-3. The lid latch rides over surface 60D-2, squeezing the seal member, then moves into position against the locking surface 60D-3. The compressed seal 70 provides appropriate force to hold latch and seal into place where locking surface 60D-3 on the vessel and a corresponding locking edge of the lid latch are angled providing a locking taper, thereby preventing the latch from unlatching.

Figure 3A:
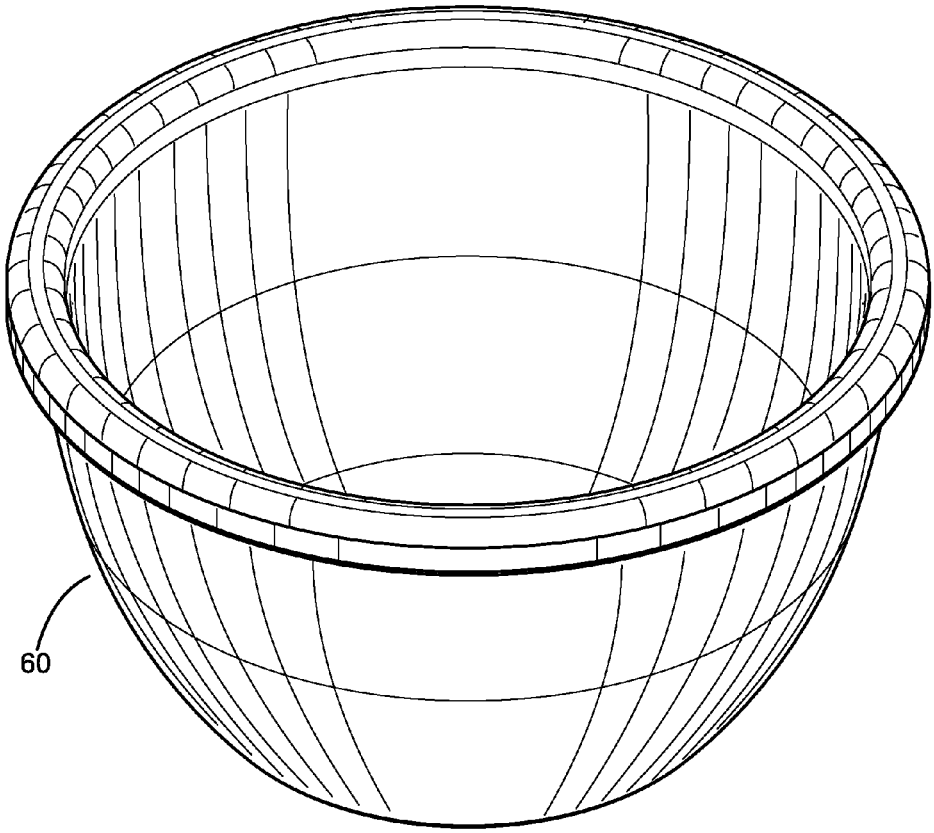
FIG. 3A is an isometric view of the bowl of FIG. 1.
Figure 3B:
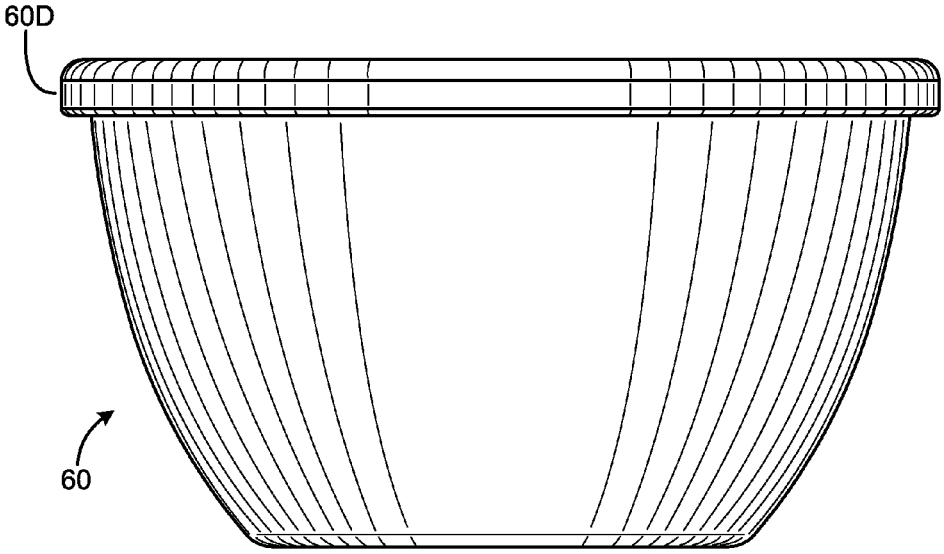
FIG. 3B is a front elevation view of the bowl of FIG. 1.
Figure 3C:
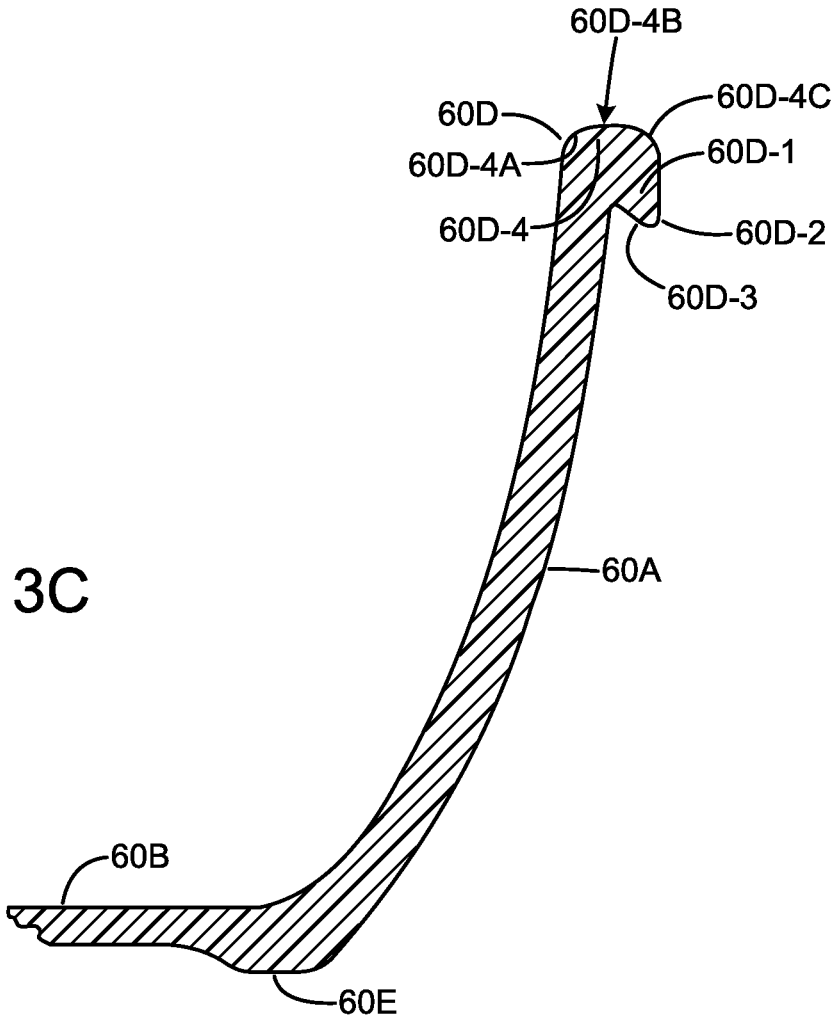
FIG. 3C is a partial cross-section view of the bowl of FIG. 3A.
Figure 3D:
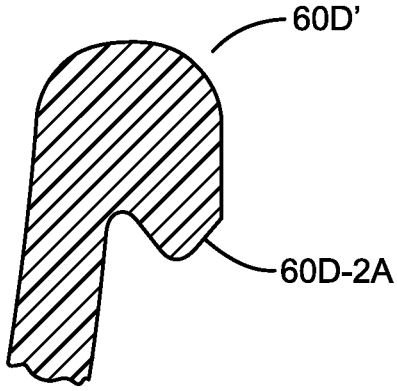
FIG. 3D is a close-up view of the peripheral lip of an alternate embodiment of the bowl as shown in FIG. 3C.

FIG. 3D illustrates an alternate embodiment of the lip portion 60D' of the vessel. The lip portion 60D' includes an angled lead-in surface 60D-2A which aids in guiding the lid latch over the lip portion 60D'. This allows for reduced latching force without reducing the retaining force. The goal is to allow for greater tolerance variations of the components without detracting from the user's experience. As shown in FIG. 3D, the lead-in surface 60-2A is a flat (in cross-section), i.e. frustro-conically-shaped, surface disposed at an angle with respect to the locking surface (60D-3, FIG. 3C).

The vessel 60 provides a sealing surface 60D-4 for engagement with the seal member 70, which in an exemplary embodiment includes the inner lip radius 60D-4A, the outer radius 60-4C and the top surface 60D-4B of the vessel. In an exemplary embodiment, the sealing surface is relatively large, to facilitate consistent contact with the seal member all the way around the vessel top, which allows for greater variations in the vessel dimensions for materials or manufacturing processes which cannot hold tight tolerances such as stoneware, glass, porcelain, etc.

The foot portion 60E provides a flat surface for vessel to sit raised on any surface and provides for alignment with a stacking depression in the lid.

In an exemplary embodiment, the seal member 70 is a substantially hollow member, fabricated by extrusion and with joined ends sealed together by welding, adhesive or the like to form a unitary member having a circular, closed configuration matching the configuration of a peripheral portion of the lid 80. The seal member 70 may be fabricated of silicon, but could be made of other materials such as extruded TPE (thermoplastic elastomer).

The seal member 70 is designed to fit into a channel 80C-3 (FIG. 4B) in the lid 80 and is removable from the lid, which may facilitate cleaning of the seal and lid. The seal member in an exemplary embodiment is held in place by friction and compression between the channel walls 80C-1 and 80C-2 of the peripheral lid portion 80C-4 of the lid.

In this exemplary embodiment, the seal 70 has a generally rectilinear cross-sectional configuration, including an outer peripheral wall portion 70A, with rounded corners 70B defined by a relatively large radius. A reinforcing rib portion 70C extends laterally across the side wall portions 70A-1, 70A-2 of the seal member intermediate the top and bottom wall portions 70A-3, 70A-4 of the seal member, to provide rigidity to the seal member for secure, intimate contact with the lid channel walls. Exemplary dimensions of the seal, for one exemplary embodiment, are height 0.375", width 0.265", corner radius 0.1" and the wall section thickness 0.04". Of course, other seal dimensions may be employed as well.

The bottom wall 70A-4 of the seal member 70 provides a sealing surface 70D, and is preferably designed with reduced support (without a vertical support rib) to allow bending or collapsing of the seal member when the lid is latched onto the vessel, which allows higher conformability than a solid or reinforced seal. The large radius of all corners 70B of the seal member 70 reduces the contact with retaining walls of lid channel, improving the crush or conformability of the seal.

The relatively large width of the seal member, i.e. greater than the manufacturing variations of stoneware, accommodates increased variance with the sealing vessel (made of ceramic materials such as stoneware, earthenware, glass, porcelain, etc.). Distance "D" (typically equal to the corner radius) from the sealing surface to lid retaining face allows D/2 crush of seal thereby providing less crush force initially and increased crush force as more crush occurs. This feature absorbs or accommodates vessel manufacturing tolerances while maintaining a good seal between the lid and vessel surfaces.

The lid 80 is preferably fabricated as a unitary structure, e.g. by injection molding, of a plastic material such as polypropylene. The lid includes a generally flat web portion 80A, and a peripheral raised peripheral portion 80B which terminates in lid edge portion 8C. A plurality of latches 80D, four in this embodiment, extend from the lid edge portion 80C at spaced locations around the lid periphery. In this example, the four latches are located at 90 degrees spacing around the lid periphery, although in other embodiments, a fewer or greater number of latches may be employed.

The edge portion 80C of the lid 80 includes a downwardly extending interior peripheral rib 80C-1 and a side wall portion 80C-2, which define a seal channel 80C-3, to provide for the secure location for the seal 70 to be held onto the lid. A seal alignment stop rib 80C-4 protrudes from the underside of the peripheral edge portion 80C into the channel 80C-3, and allows the lid peripheral edge portion 80 to have non horizontal geometry while still aligning the symmetric seal 70 into the lid at the correct height in the channel. The stop rib 80C-4 prevents the seal 70 from going all the way to the bottom of the channel and twisting on the non flat surface.

Figure 1B:
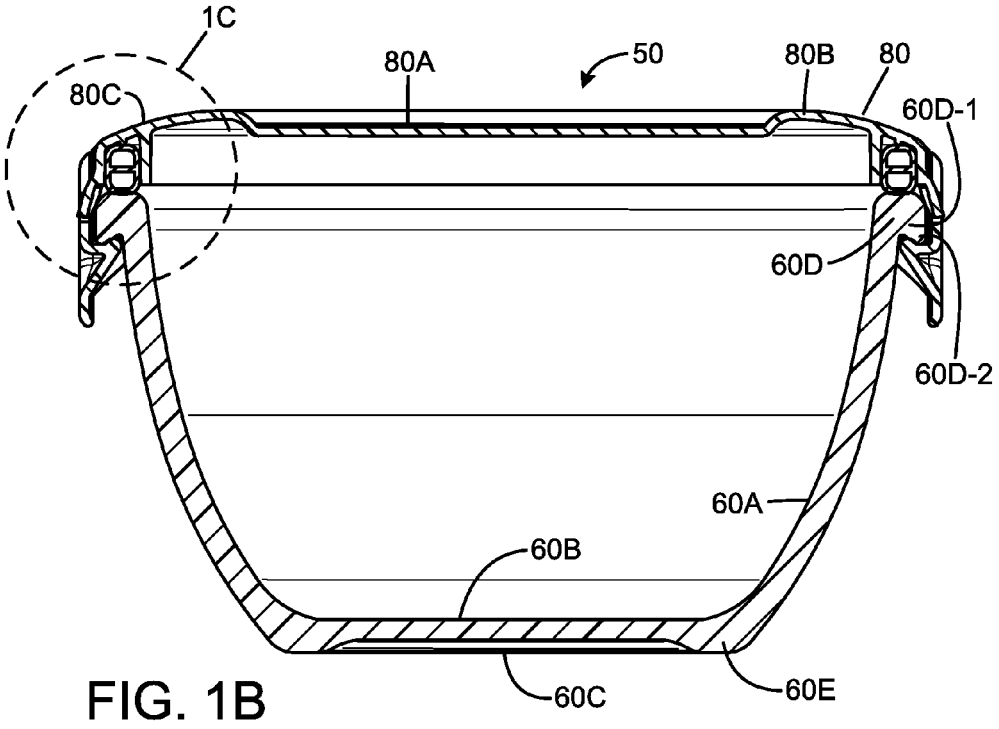
FIG. 1B is a cross-section view taken along line 1B-1B of FIG. 1A.
Figure 1C:
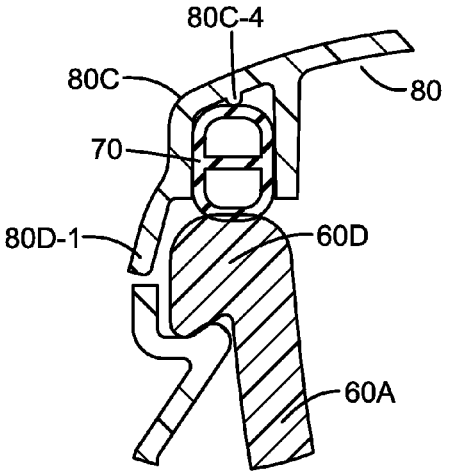
FIG. 1C is a close up view of the area within circle 1C of FIG. 1B.
Figure 1D:
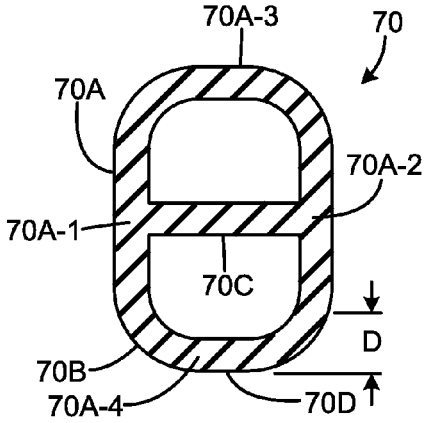
FIG. 1D is a cross-sectional view of an exemplary embodiment of a seal member.
Figure 2A:
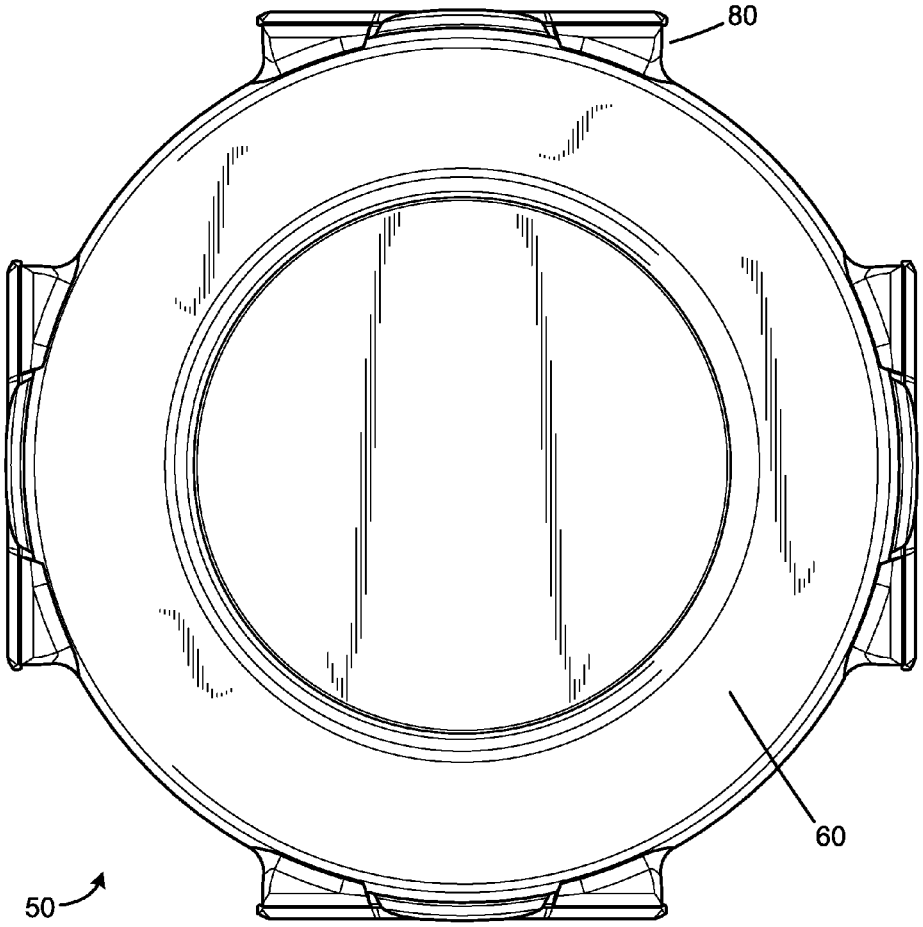
FIG. 2A is a top view of the bowl and lid of FIG. 1.
Figure 2B:
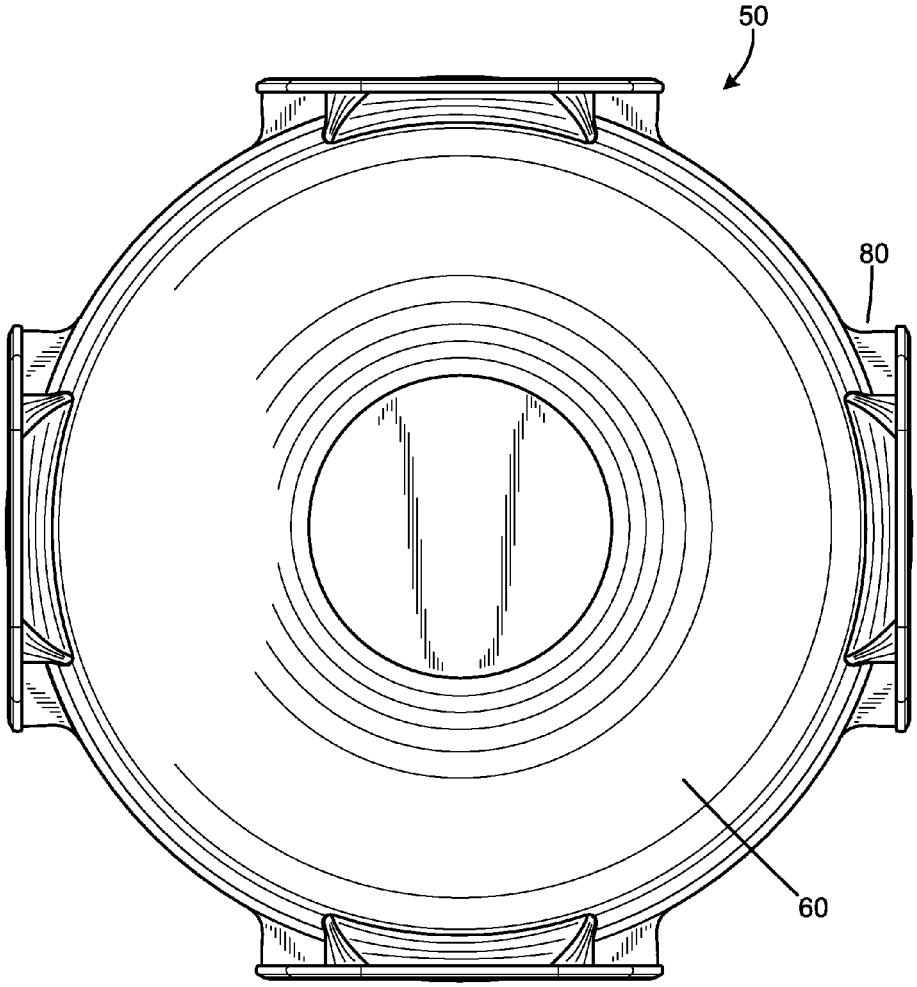
FIG. 2B is a bottom view of the bowl and lid of FIG. 1.
Figure 4A:
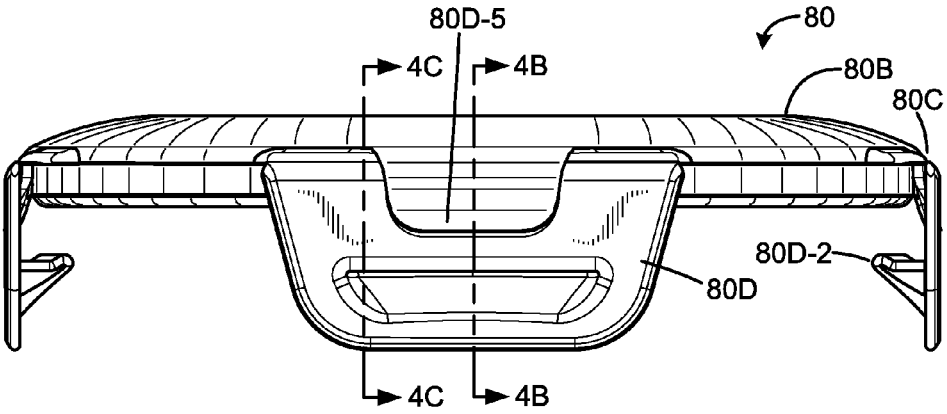
FIG. 4A is a front elevation view of the lid of the bowl and lid embodiment of FIG. 1.
Figure 4B:
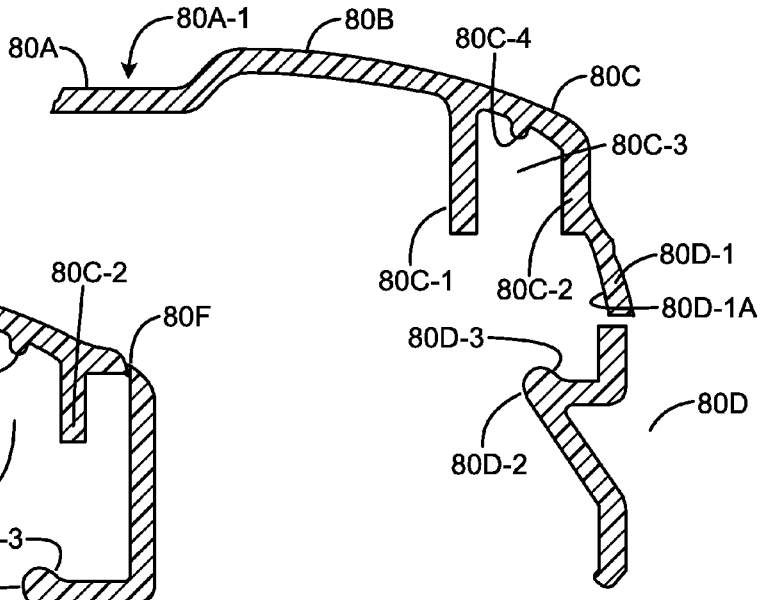
FIGS. 4B and 4C are cross-sectional views taken along lines 4B-4B and 4C-4C, respectively, of FIG. 4A.
Figure 4C:
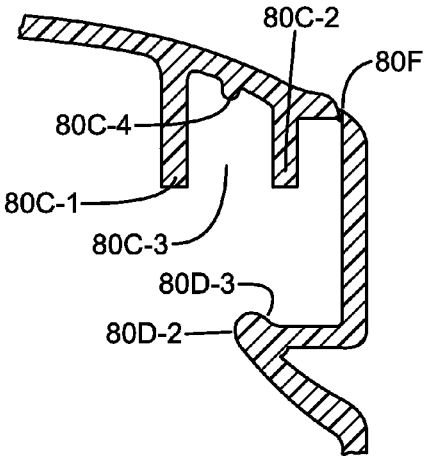
Figure 5A:
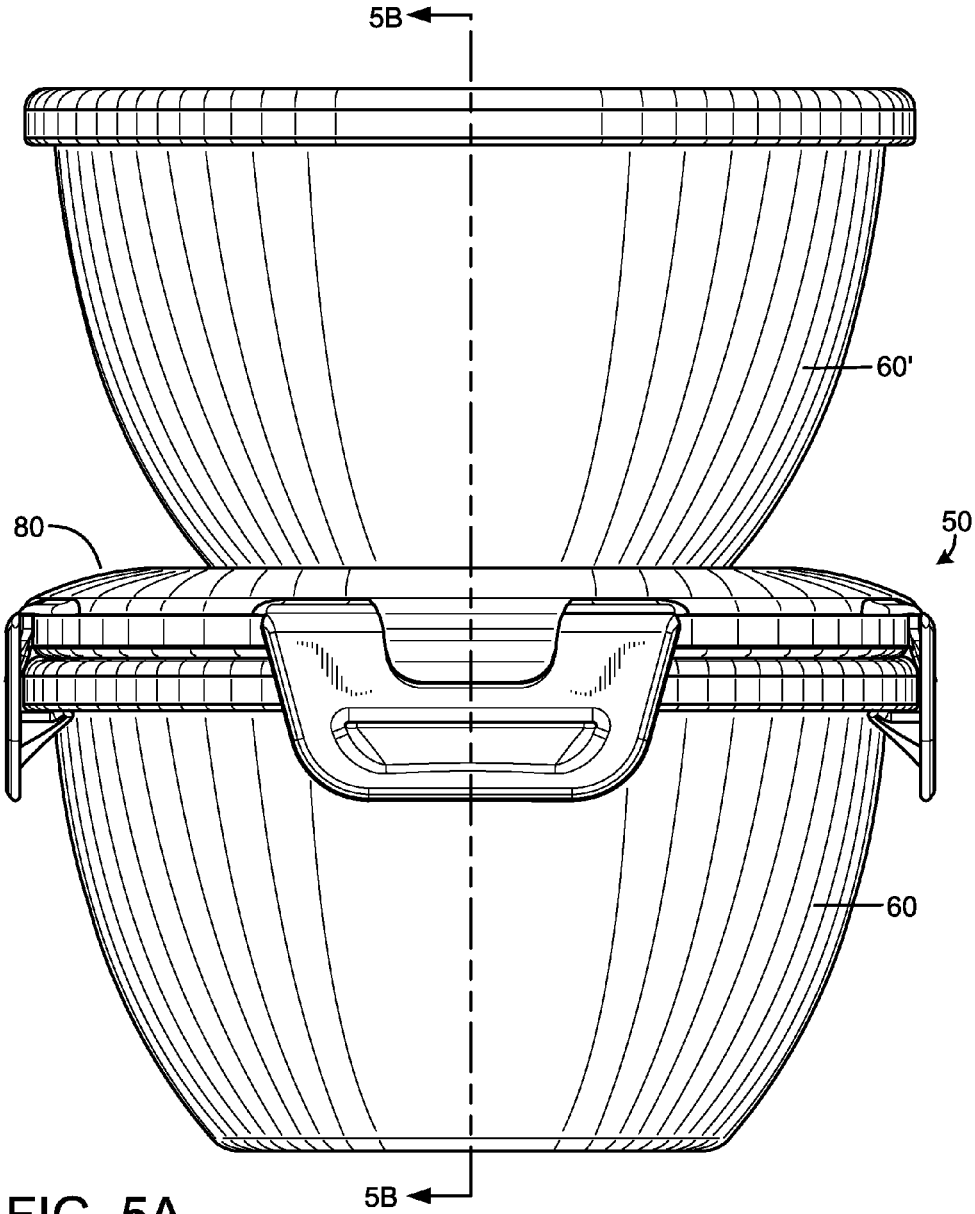
FIG. 5A illustrates a bowl-lid combination with an additional bowl stacked on the lid of the first.
Figure 5B:
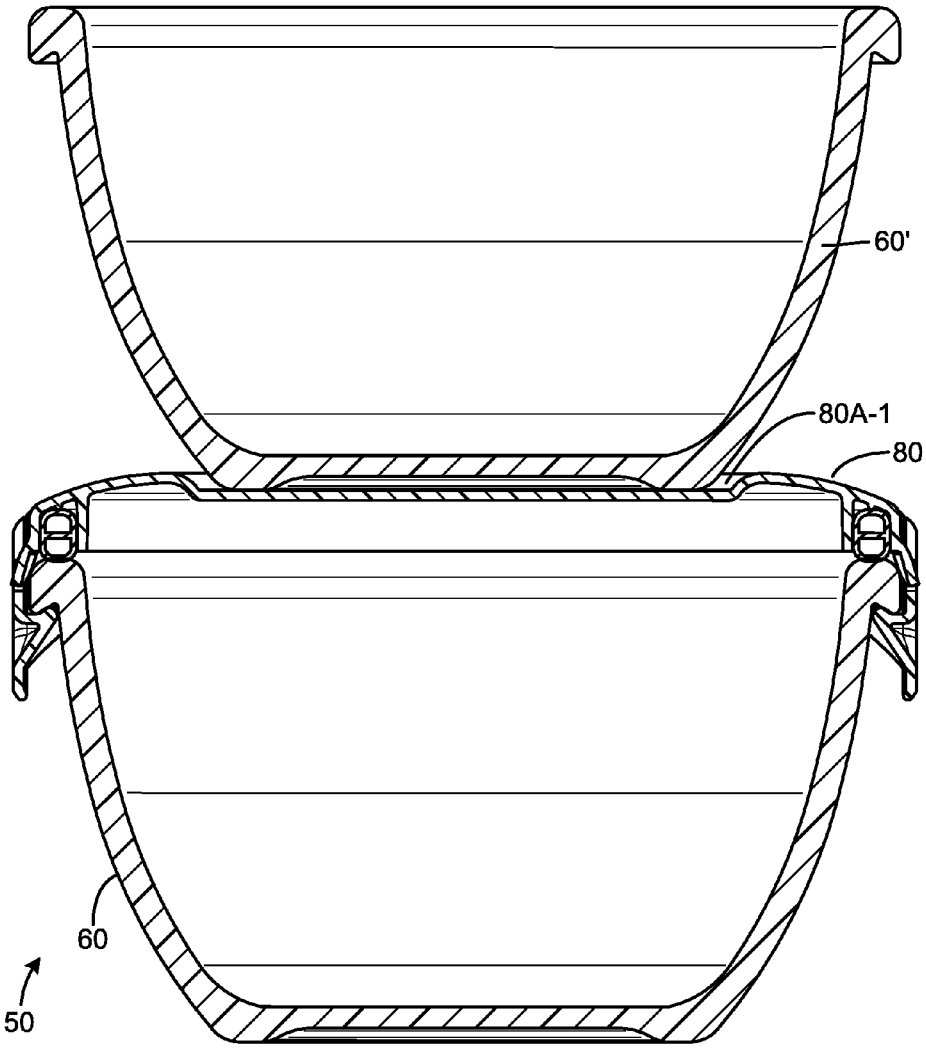
FIG. 5B is a cross-sectional view taken along line 5B-5B of FIG. 5A.
Figure 6A:
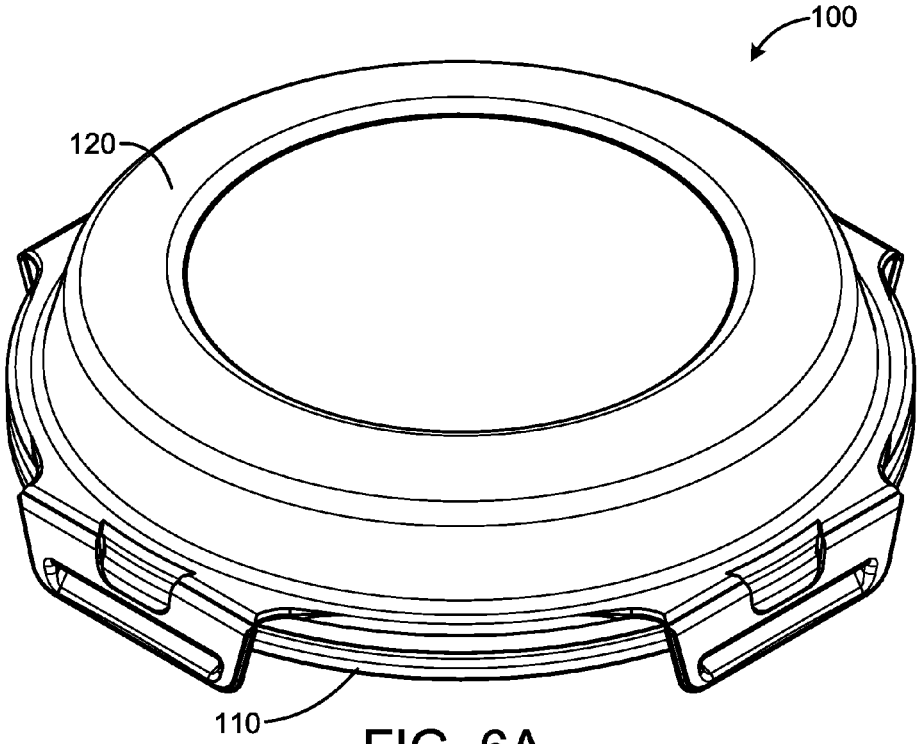
FIG. 6A is an isometric view of another embodiment, in this case a plate with a lid in an attached configuration.
Figure 6B:
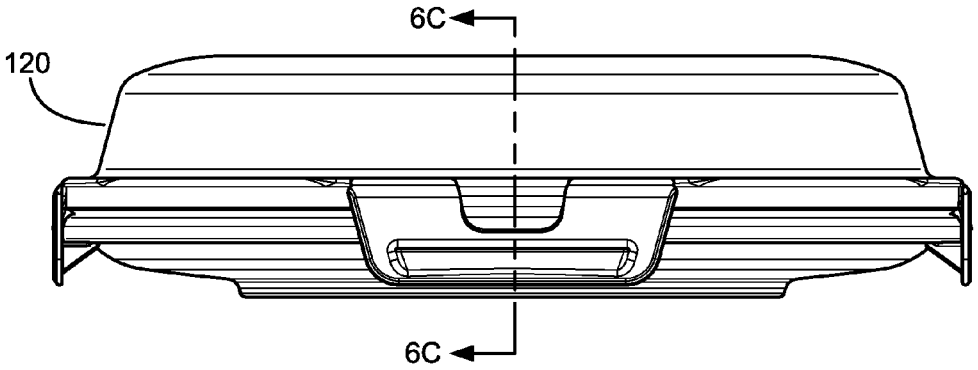
FIG. 6B is a front elevation view of the plate and lid of FIG. 6A.
Figure 6C:
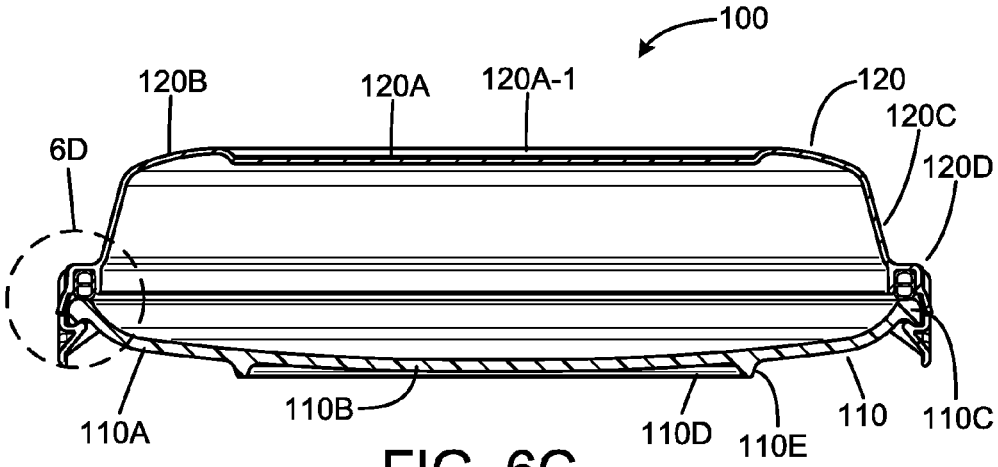
FIG. 6C cross-sectional view taken along line 6C-6C of FIG. 6B.
Figure 6D:
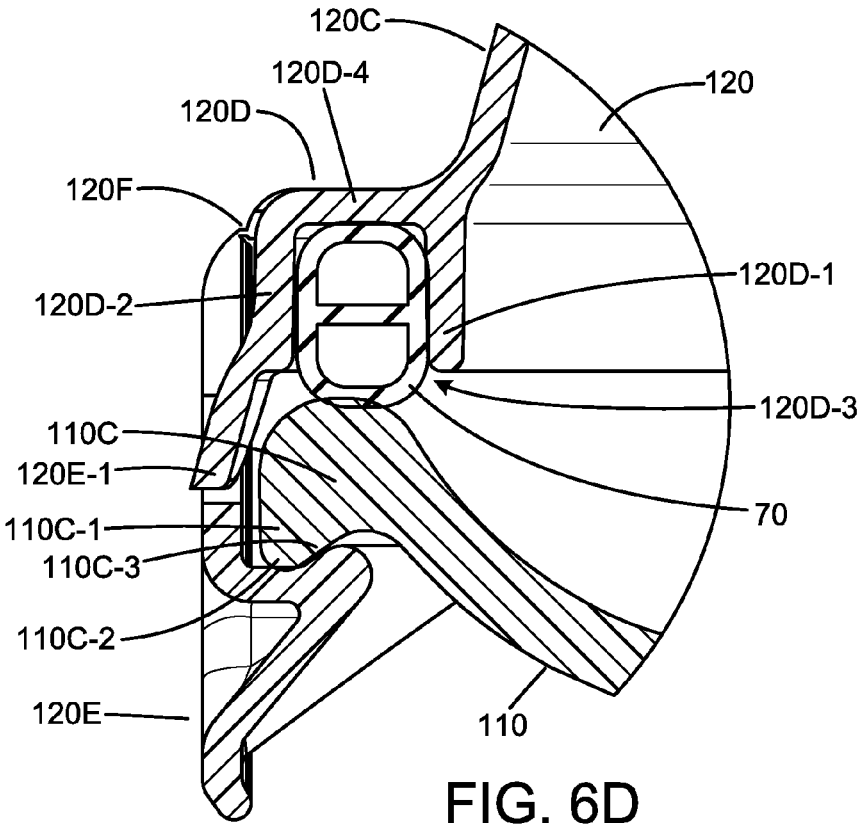
FIG. 6D is a close-up of the area within circle 6D of FIG. 6C.
Figure 7A:
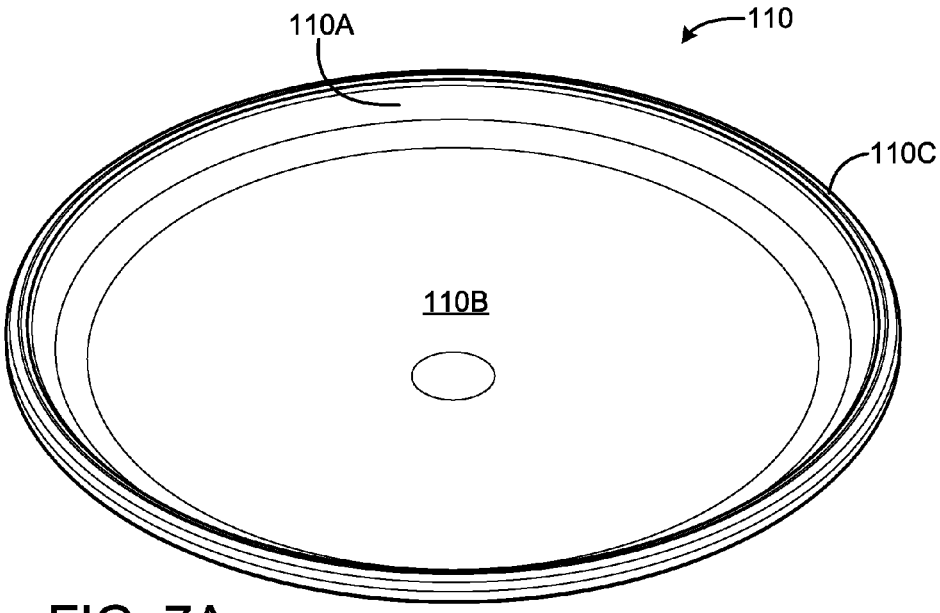
FIG. 7A is an isometric view of the plate of FIG. 6A.
Figure 7B:
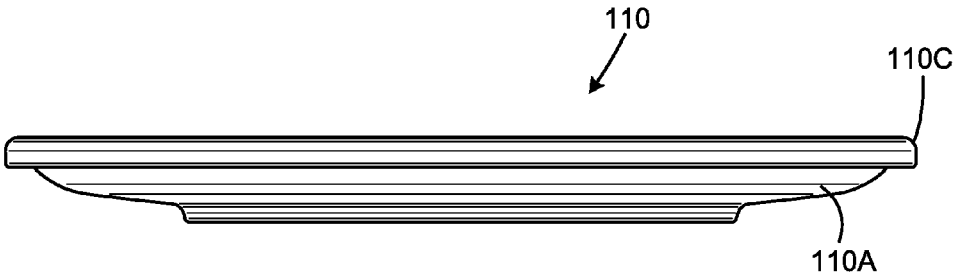
FIG. 7B is a front elevation view of the plate of FIG. 7A.
Figure 7C:
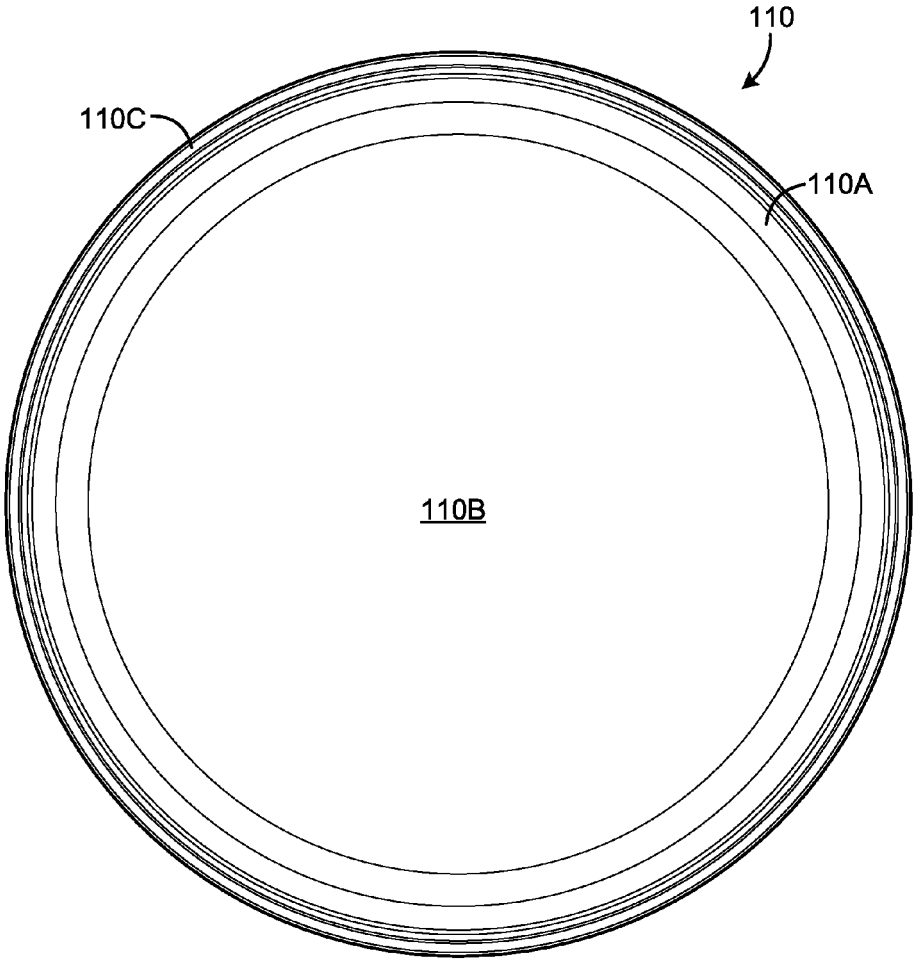
FIG. 7C is a top view of the plate of FIG. 7A.
Figure 7D:
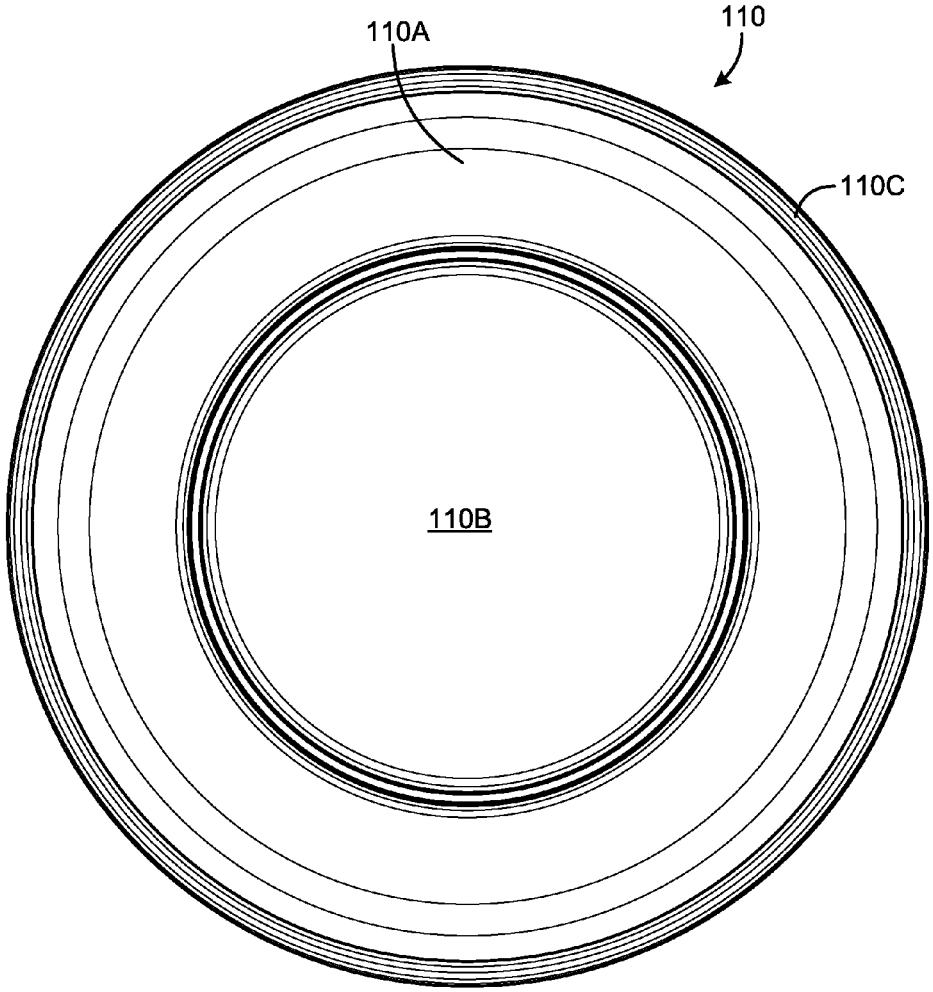
FIG. 7D is a bottom view of the plate of FIG. 7A.
Figure 8A:
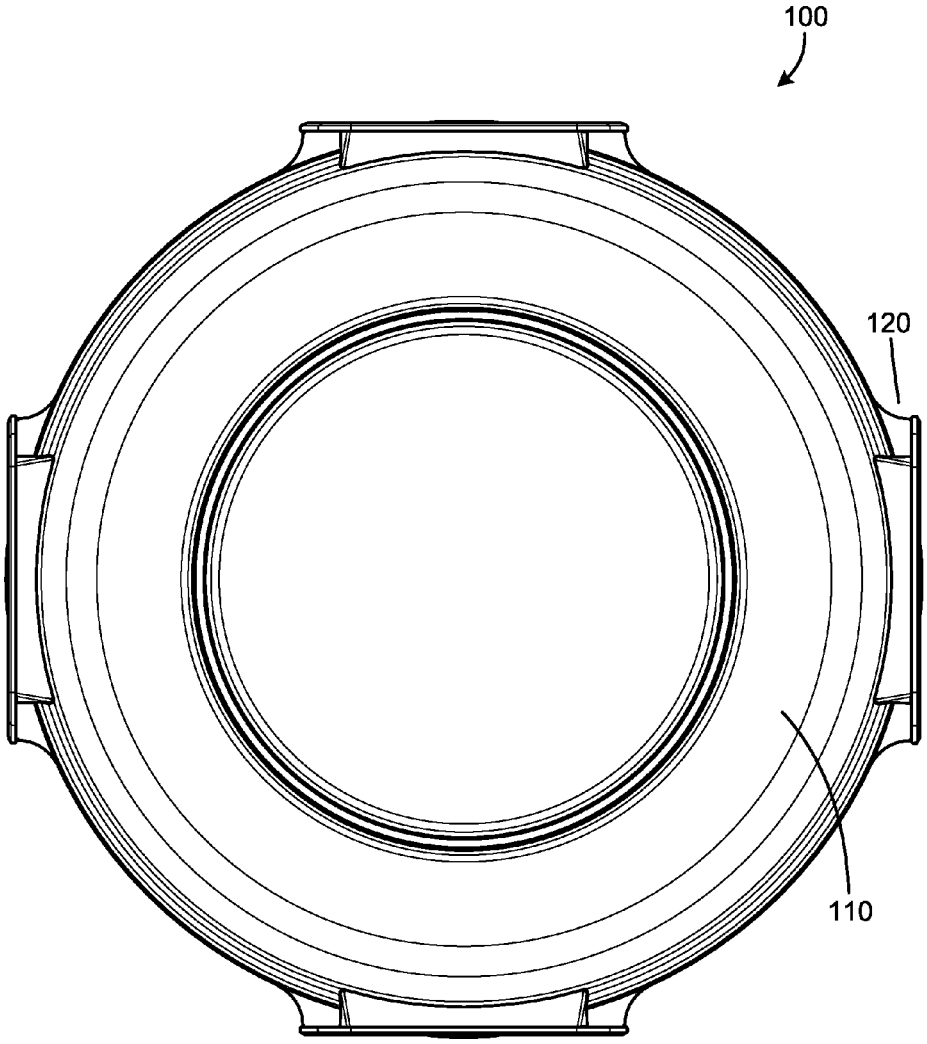
FIG. 8A is a bottom view of the plate and lid of FIG. 6A.
Figure 8B:
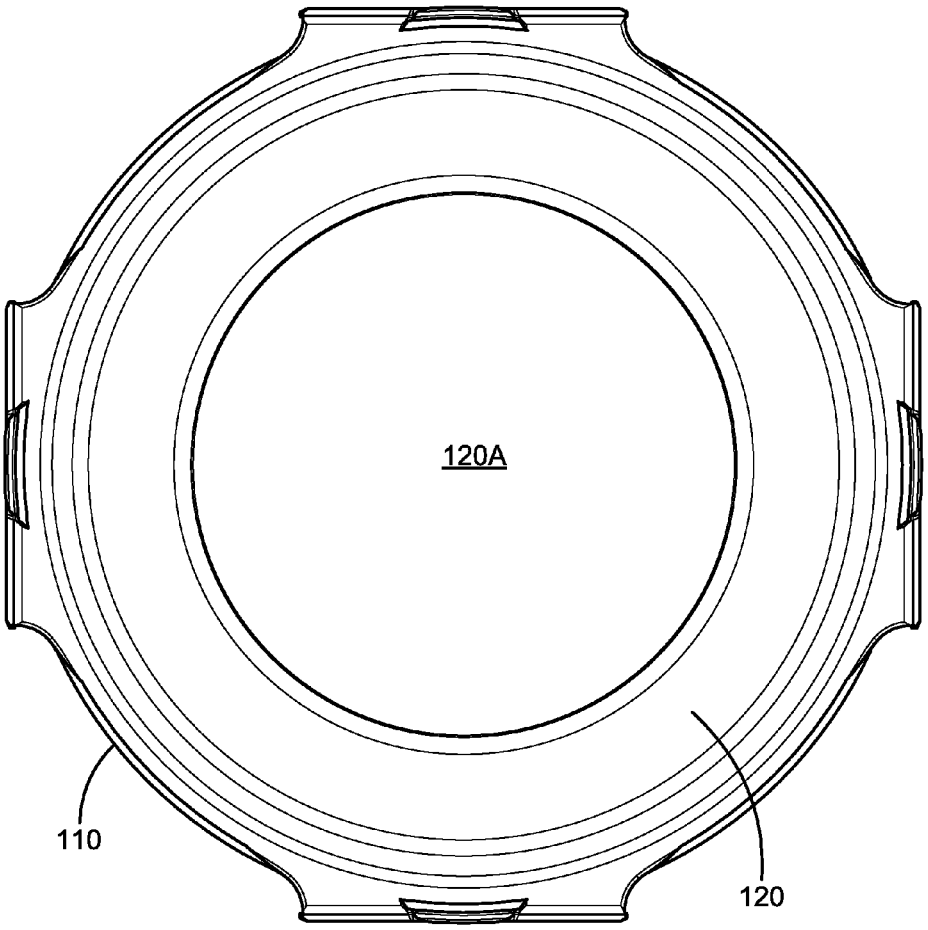
FIG. 8B is a top view of the plate and lid of FIG. 6A.
Figure 9A:
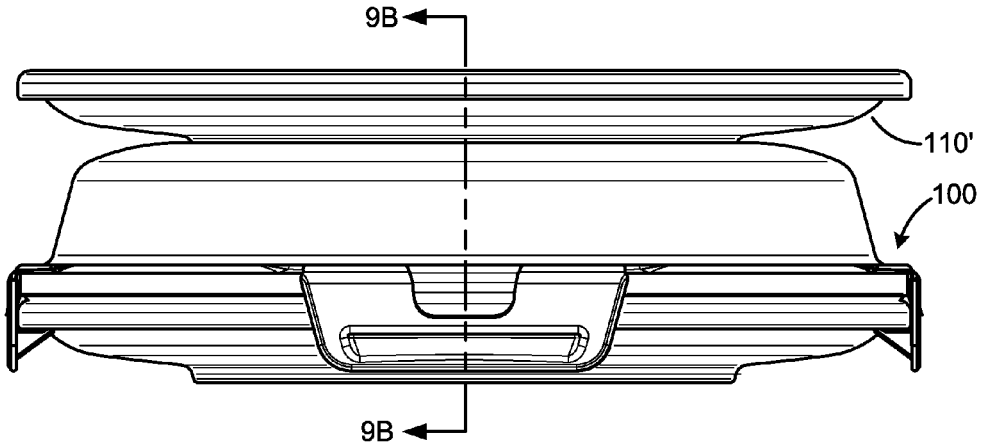
FIG. 9A is a front elevation view of a plate with lid assembled as in FIG. 6A, and with a second plate in a stacked configuration on the lid.
Figure 9B:
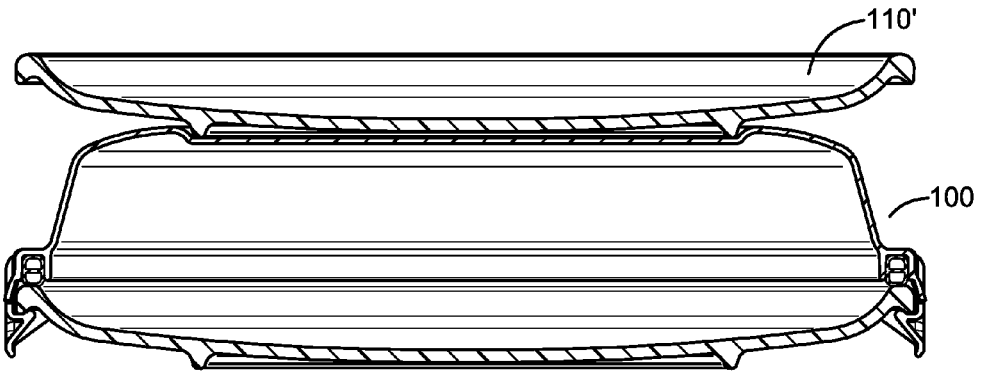
FIG. 9B is a cross-sectional view taken along line 9B-9B of FIG. 9A.

The latches 80D are shown in further detail in the cross-sectional views, e.g. FIGS. 4B and 4C. Alignment tab portions 80D-1 extend from the bottom of the lid edge portion 80C at each latch, and serve to align the lid 80 onto the vessel 60 in the correct orientation and within the tolerance of the latch. In this embodiment, the alignment tab portions underlie the latches, but do not extend around the entire periphery of the lid. In other embodiments, the alignment tab may extend around a larger portion of the lid, or be displaced from the latches. The alignment tab portions include an angled surface 80D-1A which is angled outwardly and away from the lid edge portion, and contacts the vessel peripheral edge portion and guides the lid 80 into position on the vessel while preventing misalignment. The alignment features 80D-1 contact the outer surface of the vessel periphery, and do not extend into the internal vessel volume, i.e. the vessel food storage volume, to allow for alignment without violating the food storage volume. As shown in FIG. 1B, when attached, no features of the lid extend into the food storage volume.

The latches 80D are integrally molded as part of the lid 80, in an exemplary embodiment. The respective latches 80D each rotate about a living hinge portion 80F connecting the latch to the peripheral edge portion of the lid. There are latch cutout regions 80D-5 are void or open areas, and allow rotation of the latch without interference with alignment feature 80D-1. FIGS. 4A-4C illustrate the lid with the latches in the assembled or latched position as they would be when assembled onto a vessel. Each latch 80D has a curved latching face 80D-2, which contacts the exterior of the vessel lip and guides the latch over the vessel lip into a locked position. The latch is held in position with a detent surface 80D-3.

The raised peripheral portion 80B of the lid 80, with the flat web portion 80A, defines a stacking depression 80A-1 which allows for alignment and secure stacking of like vessels. This feature is further illustrated in FIGS. 5A and 5B, in which a vessel 60' is stacked on the top of the lid 80 of the vessel and lid system 50, with the bottom of the vessel 60' received into the stacking depression 80A-1 of the vessel and lid combination 50. The raised sides of the lid defining the depression serve to align the vessel 60' and maintain the vessel 60' in the stacked position.

An alternate embodiment of a vessel and lid system 100 is illustrated in FIGS. 6A-10B. In this embodiment, the vessel 110 is a plate, e.g. a dinner plate or salad plate in size, although larger or smaller sizes may also be employed. The system further includes a lid 120 and a seal member 70 which may be of the same construction as seal member 70 described above regarding the system 50.

The vessel 110 is a relatively shallow vessel, suitable for use as a serving, dinner or salad plate. An exemplary embodiment of the vessel 110 is fabricated of a ceramic or glass material, and includes a sidewall portion 110A, a bottom portion 110B, and a peripheral lip portion 110C at the outer edge of the sidewall portion. The vessel 110 has a bottom recess portion 110D circumscribed by a bottom rib or foot portion 110E. The lip portion 110C includes a locking lip 110C-1 which provides a locking surface for the latching lid. The locking lip includes a latch receiving curved surface 110C-2 and locking surface 110C-3. The lid latch rides over surface 110C-2, squeezing the seal member, then moves into position against the locking surface 110C-3. The compressed seal 70 provides appropriate force to hold latch and seal into place, where locking surface 110C-3 on the vessel and a corresponding locking edge of the lid latch are angled providing a locking taper, thereby preventing the latch from unlatching.

The lid 120 includes a relatively flat web portion 120A, a raised peripheral region 120B, a lid dome sidewall portion 120C, and a lid peripheral edge portion 120D. The web portion 120A is elevated by the relatively tall sidewall portion 120B, forming a lid dome structure. The lid dome structure provides additional protected volume within the lid for food on the plate. Thus the lid can be attached to the plate vessel without disturbing food items extending above the top peripheral edge of the plate.

The lid 120 includes a seal channel 120D-3 between interior rib 120D-1 and outer side wall 120D-2, in a manner similar to that described above regarding the seal channel defined in lid 80 above. The seal channel 120D-3 is configured for receiving the seal member 70. In this embodiment, a stop rib is not employed in the channel 120D-3, since the lid peripheral wall portion 120D-4 is substantially flat, and the rib 120D-1 and side wall portion 120D-2 extend in generally perpendicular alignment to the wall portion 120D-4. As a result, there is no tendency for the seal member to twist within the seal channel.

Alignment tab portions 120E-1 extend from the bottom of the lid edge portion 120D at each latch, and serve to align the lid 120 onto the vessel 110 in the correct orientation and within the tolerance of the latch. In this embodiment, the alignment tab portions underlie the latches, but do not extend around the entire periphery of the lid.

The lid 120 includes similar latching features as described above with respect to the latch 80 for the bowl vessel embodiment. Thus, in this embodiment, the lid includes four latches 120E integrally formed with the lid, and connected to the lid peripheral portion 120D by living hinges 120F.

The raised peripheral portion 120B of the lid 120, with the flat web portion 120A, defines a stacking depression 120A-1 which allows for alignment and secure stacking of like vessels. This feature is further illustrated in FIGS. 9A and 9B, in which a plate 110' is stacked on the top of the lid 120 of the vessel and lid system 100, with the bottom of the plate 110' received into the stacking depression 120A-1 of the vessel and lid combination 100. The raised sides of the lid defining the depression serve to align the vessel 110' and maintain the vessel 110' in the stacked position.

Figure 10A:
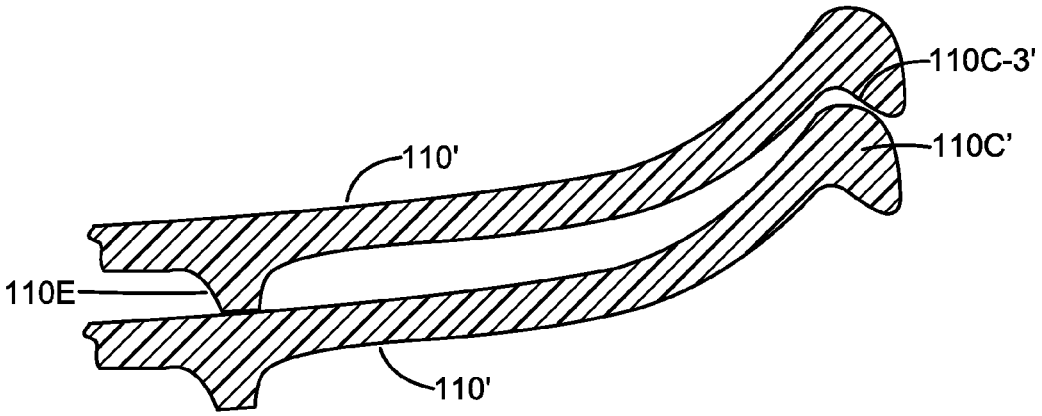
FIG. 10A is a diagrammatic partial cross-sectional view of an alternate embodiment of nested/stacked plates.
Figure 10B:
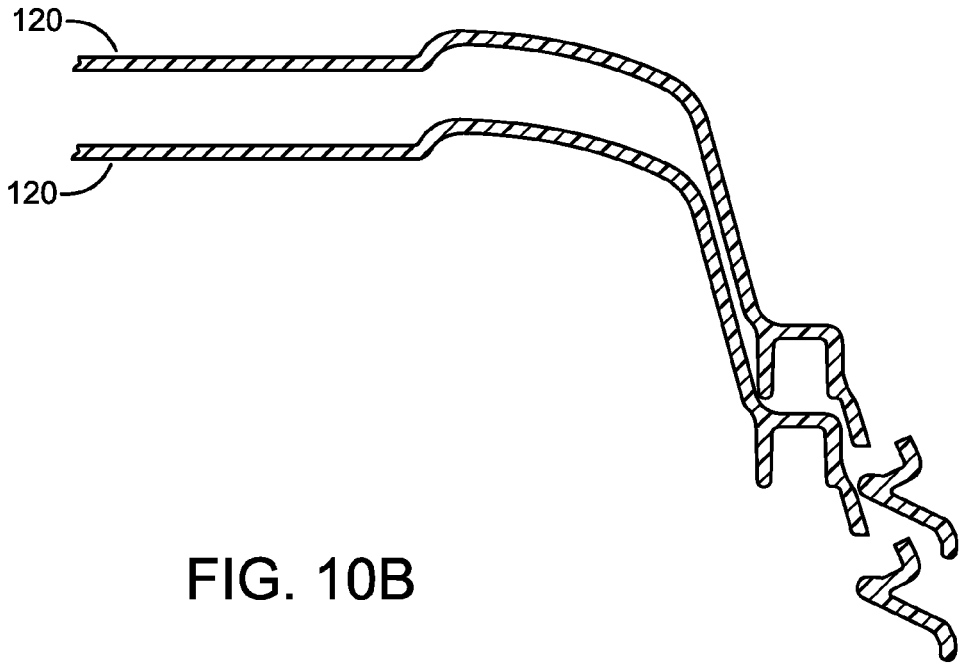
FIG. 10B is a partial cross-sectional view of two lids as in the lid of FIG. 6A in a stacked/nested configuration.

The lid 120 is further adapted to enable nesting of like lids. This feature is shown in FIG. 10B, in which two lids 120 are shown in the nested configuration. The lid dome sidewall portion 120C of the lid is tapered sufficiently to allow for nesting.

The plate vessels 110 are configured for stacking together in a stacked configuration for storage. An alternate embodiment of the plate 110' illustrated in FIG. 10A has a modified lip portion 110C', in which the latching surface 110C-3' has a slightly changed angle, for improved stacking of like plates. The foot of the upper plate sits on inner surface of the lower plate. The interior surface of the plate is sufficiently sloped for the upper plate to locate the plate center of the lower plate. The upper plate is held in position for secure stacking of many plates by latch retaining face 110C-3' and the peripheral edge 110C' of the lower plate.

Although the foregoing has been a description and illustration of specific embodiments of the subject matter, various modifications and changes thereto can be made by persons skilled in the art without departing from the scope and spirit of the invention.

What is claimed is:

1. A dinnerware vessel-lid combination comprising:

a ceramic or glass vessel having an open top surrounded by a peripheral edge with a peripheral locking lip defining a locking surface;

a lid fabricated of a plastic material, and configured to attach to the open top of the vessel by a set of latches integrally formed with the lid; and an elastomeric seal structure assembled to the lid and configured to provide an air-tight seal between the lid and the peripheral edge of the vessel when the lid is attached to the vessel;

wherein the vessel is a unitary structure, defining a sidewall portion and a bottom wall, the sidewall portion having a top peripheral portion with a lip portion including said locking lip defining said locking surface for engagement by the set of latches, the top peripheral portion including the peripheral edge, and wherein the locking lip further includes an angled lead-in surface portion to aid in guiding the latch over the locking lip, the lead-in surface comprising a frustro-conically-shaped surface disposed at an angle with respect to the locking surface; and wherein the lid includes a plurality of alignment tab portions extending from a bottom of the lid peripheral edge portion and including an angled surface configured to contact the vessel peripheral edge as the lid is positioned on the vessel to guide the lid into position on the vessel while preventing misalignment.

2. The combination of claim 1, wherein the vessel is a dinnerware bowl.

3. The combination of claim 1, wherein the vessel is a plate configured for serving a meal as a serving, dinner or salad plate.

4. The combination of claim 1, wherein each latch includes an open area positioned to allow rotation of the latch without interference with a corresponding alignment tab portion.

5. A dinnerware vessel-lid combination comprising:

a ceramic or glass vessel having an open top surrounded by a peripheral edge with a peripheral locking lip defining a locking surface;

a lid fabricated of a plastic material, and configured to attach to the open top of the vessel by a set of latches integrally formed with the lid; and an elastomeric seal structure assembled to the lid and configured to provide an air-tight seal between the lid and the peripheral edge of the vessel when the lid is attached to the vessel;

wherein the vessel is a unitary structure, defining a sidewall portion and a bottom wall, the sidewall portion having a top peripheral portion with a lip portion including said locking lip defining said locking surface for engagement by the set of latches, the top peripheral portion including the peripheral edge, and wherein the locking lip further includes an angled lead-in surface portion to aid in guiding the latch over the locking lip, the lead-in surface comprising a frustro-conically-shaped surface disposed at an angle with respect to the locking surface; and wherein the vessel is a plate vessel configured for stacking with like plate vessels in a stacked configuration for storage, the plate vessel bottom surface having a protruding foot structure configured to be received onto an interior surface of a like plate vessel in stacking configuration.

* * * * *